US006037115A

United States Patent [19]

Alton et al.

[11] Patent Number: 6,037,115

[45] Date of Patent: Mar. 14, 2000

[54] PHOTOTHERMOGRAPHIC AND THERMOGRAPHIC FILMS CONTAINING LOW LEVELS OF FORMATE TO PREVENT FOG

[75] Inventors: Alfred J. Alton, Hilton; James P. Besse, Spencerport; Peter J. Cowdery-Corvan, Webster; Leo J. Magee, Jr., Buffalo; Michael W. Martin, Fairport, all of N.Y.

[73] Assignee: Eastman Kodak Company, Rochester, N.Y.

[21] Appl. No.: 08/890,892

[22] Filed: Jul. 10, 1997

Related U.S. Application Data

[63] Continuation-in-part of application No. 08/651,424, May 22, 1996, abandoned.

[51] Int. Cl.[7] ..... G03C 1/498

[52] U.S. Cl. ..... 430/619; 430/617; 430/620

[58] Field of Search ..... 430/617, 620, 430/619

[56] References Cited

U.S. PATENT DOCUMENTS

| | | |
|---|---|---|
| 2,681,294 | 6/1954 | Beguin . |
| 2,761,791 | 9/1956 | Russell . |
| 2,875,048 | 2/1959 | Haist et al. . |
| 3,152,904 | 10/1964 | Sorensen et al. . |
| 3,240,603 | 3/1966 | Schuler et al. . |
| 3,348,945 | 10/1967 | Mader et al. . |
| 3,411,912 | 11/1968 | Dykstra et al. . |
| 3,457,075 | 7/1969 | Morgan et al. . |
| 3,635,719 | 1/1972 | Ohkubo et al. . |
| 3,645,739 | 2/1972 | Ohkubo et al. . |
| 3,672,904 | 6/1972 | de Mauriac et al. . |
| 3,700,457 | 10/1972 | Youngquist . |
| 3,706,565 | 12/1972 | Ericson . |
| 3,713,833 | 1/1973 | Lindholm et al. . |
| 3,756,829 | 9/1973 | Ohkubo et al. . |
| 3,761,279 | 9/1973 | de Mauriac . |
| 3,801,321 | 4/1974 | Evans et al. . |
| 3,801,330 | 4/1974 | Brinckman et al. . |
| 3,827,889 | 8/1974 | Ohkubo et al. . |
| 3,839,041 | 10/1974 | Hiller . |
| 3,846,136 | 11/1974 | Sullivan et al. . |
| 3,871,887 | 3/1975 | Jones . |
| 3,941,898 | 3/1976 | Wynn . |

FOREIGN PATENT DOCUMENTS

| | | |
|---|---|---|
| 815526 | 6/1969 | Canada . |
| 1-261224 | 10/1989 | Japan . |
| 943476 | 12/1963 | United Kingdom . |
| 951644 | 3/1964 | United Kingdom . |
| 954453 | 4/1964 | United Kingdom . |
| 1362970 | 8/1974 | United Kingdom . |

*Primary Examiner*—Thorl Chea
*Attorney, Agent, or Firm*—Edith A. Rice

[57] ABSTRACT

A method of obtaining a photothermographic or thermographic film with reduced fog, such as pepper fog, comprises preparing a dispersion of: an oxidation-reduction image-forming combination comprising: a silver salt oxidizing agent and an organic reducing agent with: a synthetic polymer-peptized photosensitive silver halide, and a cyclic imide toner in a non-gelatin polymeric binder and mixing with said dispersion a sensitizing concentration of non-silver iodide salt formed from an ionic formate the improvement wherein said non-silver iodide salt contains less than about 100 micrograms of ionic formate per gram of iodide salt or the film contains less than about 0.5 micrograms of ionic formate per gram of emulsion in the film.

28 Claims, No Drawings

PHOTOTHERMOGRAPHIC AND THERMOGRAPHIC FILMS CONTAINING LOW LEVELS OF FORMATE TO PREVENT FOG

CROSS-REFERENCE TO RELATED APPLICATIONS

This is a continuation-in-part of application Ser. No. 08/651,424 filed May, 22, 1996 entitled, "PHOTOTHERMOGRAPHIC AND THERMOGRAPHIC FILMS CONTAINING LOW LEVELS OF FORMATE TO PREVENT FOG" by Alton et al, now abandoned.

FIELD OF THE INVENTION

The present invention relates to a heat developable photosensitive material and more particularly to a photothermographic or thermographic composition comprising a silver salt oxidizing agent and organic reducing agent, a synthetic polymer-peptized photosensitive silver halide for photothermographic compositions, a toner in a polymeric binder and a non-silver iodide salt

BACKGROUND OF THE INVENTION

Silver halide photography has been much more universally employed in the past, compared with electrophotography, diazo photography and the like, because of the superior photographic characteristics such as sensitivity, gradation, etc., of silver halide photography. However, silver halide photography requires much time and labor, because the silver halide light-sensitive material employed in this method must be subjected to several processings including an image-exposure, a developing process using a developer and process for preventing the developed image from changing color or deteriorating under normal room-illumination and preventing the non-developed portion (hereinafter background) from blackening, e.g., processing including stop, fixation, washing and rinsing, stabilizing and other similar processes. In addition, the chemical agents which may be used in this method are dangerous to the human body, and the processing room and the workers' hands and clothes are often stained with these agents. Therefore, it has been strongly desired to improve silver halide photography so that the light-sensitive materials can be treated in a dry condition instead of treatment with solutions, and so that the processed images are maintained stable. In order to solve this problem, many efforts have been made.

A first method which has been developed thus far includes the so-called combined developing and fixing bath method wherein two procedures in a conventional silver halide photography, developing and fixing procedures, can be replaced by one procedure, as disclosed in U.S. Pat. No. 2,875,048; British Patent No. 954,453; and German Patent Application OLS No. 1,163,142. A second method attempts to replace wet procedures in conventional silver halide photography with dry procedures, as disclosed in German Patent Application OLS No. 1,174,159; British Patent Nos. 943,476 and 951,644; and so on. A third method uses as a main light-sensitive component a silver salt of a long chain aliphatic carboxylic acid such as silver behenate, silver saccharin, silver benzotriazole, etc., and a catalytic amount of a silver halide simultaneously, as disclosed in U.S. Pat. Nos. 3,152,904; 3,457,075; 3,635,719; 3,645,739; and 3,756,829 and Canadian Patent No. 811,677; and so on.

However, the unexposed parts of the heat-developed light-sensitive materials which have so far been proposed, for example, the unexposed parts of the compositions containing the silver salts of fatty acids such as silver behenate, etc., reducing agents and catalytic amounts of silver halides, become to a considerable extent black which makes the distinction between the images and the background difficult because there is very little contrast between the black images formed on the exposed parts by heating (image density) and the fogged black background. Therefore, a reduction of fog has been an important subject in this art. Moreover, storage of light-sensitive materials for a long time before use under conditions of high temperature (30° C.–50° C.) and high humidity (more than 50% relative humidity) causes fog resulting in the formation of indistinguishable images.

A particular problem with dry laser films containing a silver behenate melt is fog, such as pepper fog, which may appear as black spots in unexposed areas on film such as microfilm.

In JP 1/26,224 Oct. 15, 1989 a method of producing a high purity sodium iodide by reduction of iodine using formic acid as the reducing agent is described.

U.S. Pat. No. 3,871,887 describes a photothermographic composition containing a halide salt to increase the photosensitivity of the photothermographic composition.

U.S. Pat. No. 3,801,330 describes the use of sodium formate, among many other materials to thermally liberate a basic material which can be used to accelerate development. The patent describes the use of a water based gel binder system and does not describe a silver behenate-type material in their formulation. The silver formate formed in the process of the patent is very unstable and rapidly decomposes to a black, bubbling tar in the presence of silver behenate.

However, many materials in a photothermographic and thermographic composition are accompanied by serious fog production. Under these circumstances, further improvement is required with respect to said photothermographic materials.

SUMMARY OF THE INVENTION

The present invention is therefore intended to overcome problems as described above.

One object of the present invention is to provide a dry laser photothermographic or thermographic film with reduced fog, black spots or pepper fog.

Another object of the present invention is to provide a photographic material capable of forming an image of high density with less fog.

In order to achieve said objects, it has now been found according to the present invention that the foregoing problem can be related to the presence of ionic formate in the film or, specifically in the iodide salt or from other sources which are used in the melt formulation of the photothermographic compound. It has been found that if the photothermographic or thermographic film contains below 0.5 micrograms of ionic formate per gram of emulsion in the film or if the ionic formate concentration in the iodide salt is less than 100 micrograms of ionic formate per gram of iodide salts, the fog, black spots or pepper fog are greatly reduced or eliminated.

Thus, if the formate is present from the iodide salt, the method of preparing a photothermographic composition comprises:

A. preparing a dispersion of:

a. an oxidation-reduction image-forming combination comprising:

i. a silver salt oxidizing agent and
ii. an organic reducing agent with:

b. a synthetic polymer-peptized photosensitive silver halide, and c. a toner in d. a non-gelatin polymeric binder and B. mixing with said dispersion a sensitizing concentration of iodide salt and C. the improvement wherein said iodide salt formed from an ionic formate contains less than about 100 micrograms of ionic formate per gram of iodide salt.

If the formate is present from the iodide salt, the method of preparing a thermographic element comprises:

A. preparing a dispersion of:

a. an oxidation-reduction image-forming calibration comprising:
i. a silver salt oxidizing agent and
ii. an organic reducing agent with:

b. a toner;

c. a non-gelatin polymeric binder and

B. mixing with said dispersion and sensitizing concentration of iodide salt formed from an ionic formate and C. the improvement wherein said iodide salt contains less than about 100 micrograms of ionic formate per gram of iodide salt Additionally, a thermographic film is prepared by:

A. preparing a dispersion of:

a. an oxidation-reduction image-forming combination comprising:
i. a silver salt oxidizing agent with
ii. an organic reducing agent b. a toner in a polymeric binder c. a non-gelatin polymeric binder and B. mixing with said dispersion a sensitizing concentration of iodide salt formed from an ionic formate and C. forming a film therefrom and D. the improvement wherein said film contains less than about 0.5 micrograms of ionic formate per gram of emulsion in the film.

A photothermographic film can also be prepared by:

A. preparing a dispersion of:

a. an oxidation-reduction image-forming combination comprising:
i. a silver salt oxidizing agent and
ii. an organic reducing agent with:

b. a synthetic polymer-peptized photosensitive silver halide, and c. a toner in d. a non-gelatin polymeric binder and B. mixing with said dispersion a sensitizing concentration of iodide salt formed from an ionic formate and C. forming a film therefrom and D. the improvement wherein said film contains less than about 0.5 micrograms of ionic formate per gram of emulsion in the film.

DETAILED DESCRIPTION OF THE PREFERRED EMBODIMENTS

The soluble iodide salt has the property of increasing the photosensitivity of the described photothermographic materials to the desired wavelengths of light for imagewise exposure. Merely adding a silver iodide emulsion to the photothermographic materials does not provide the desired increase in photosensitivity. Accordingly, the term iodide compounds or salts as employed herein is intended to exclude silver iodide. The useful concentration of iodide salt is about 0.01 mole to about 0.50 moles of the described iodide salt per mole of the photosensitive silver halide in the photothermographic material. Acceptable iodide salts according to the invention are, for instance, lithium iodide, ammonium iodide, sodium iodide, potassium iodide and mixtures of these iodides. Choice of optimum non-silver iodide salt and the optimum step in preparation will depend upon the particular thermographic or photothermographic composition, desired image, processing conditions and the like. Sodium iodide is especially useful when employing a reducing agent with a silver salt oxidizing agent, such as silver behenate, and an ex situ, poly(vinyl butyral) peptized photosensitive silver bromide in a polymeric binder such as poly(vinyl butyral).

A range of concentration of the described iodide salt can be employed. The concentration must be sufficient to provide the desired increase in photosensitivity in the described photothermographic composition. Typically, a concentration of iodide salt is about 0.01 mole to about 0.50 mole of the described non-silver iodide salt per mole of photosensitive silver halide in the described photothermographic material. A concentration of non-silver iodide salt which is about 0.01 mole to about 0.50 mole of the iodide, typically iodide, per mole of the described silver halide is usually preferable.

The method of preparing the described photothermographic composition and element comprising a dispersion of oxidation-reduction image-forming materials with ex situ, synthetic polymer peptized photosensitive silver halide, and a cyclic imide toner in a polymeric binder can vary depending on the particular photothermographic materials, desired image, processing conditions and the like. A typical method of preparing the dispersion involved thoroughly mixing the described components. These can be mixed employing any suitable apparatus such as a ball-mill or similar mixing means. One method of preparing the described dispersion and means for preparing the dispersion are set out, for instance, in Belgian Patent No. 774,436 issued Nov. 12, 1971.

The photothermographic and thermographic elements and compositions according to the invention comprise an oxidation-reduction image-forming materials which contains a silver salt oxidizing agent. The silver salt oxidizing agent can be a silver salt of an organic acid such as a fatty acid which is resistant to darkening upon illumination. An especially useful class of silver salts of organic acids is represented by the water insoluble silver salts of long-chain fatty acids which are stable to light. Compounds which are suitable silver salt oxidizing agents include, for instance, silver behenate, silver stearate, silver oleate, silver laureate, silver hydroxy stearate, silver caprate, silver myristate and silver palmitate with silver stearate and silver behenate being especially useful. In some instances silver salts can be employed as the silver salt oxidizing agent which are not silver salts of long-chain fatty acids. Such silver salt oxidizing agents which are useful include, for example, silver benzoate, silver benzotriazole, silver terephthalate, silver phthalate and the like. In most instances, however, silver behenate is most useful.

A variety of organic reducing agents can be employed in the described oxidation-reduction image-forming combination. Sulfonamidophenol reducing agents are especially useful in the described oxidation-reduction image-forming combination. Sulfonamidophenol reducing agents in photothermographic materials are described in U.S. Pat. 3,801,321 issued Apr. 2, 1974 to Evans et al. The sulfonamidophenol reducing agents useful according to the invention can be prepared employing known procedures in the art and include such compounds as described in Canadian Patent no. 815, 526 of Bard issued Jun. 17, 1969. A useful class of sulfonamidophenol reducing agents according to the invention, is represented by the structure:

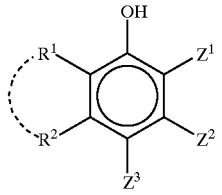

wherein $R^1$ and $R^2$ are each selected from the group consisting of hydrogen; chlorine; bromine; iodine; alkyl containing 1 to 4 carbon atoms, such as methyl, ethyl, propyl and butyl; aryl containing 6 to 12 carbon atoms such as phenyl and tolyl; arylsulfonyl containing 6 to 12 carbon atoms, such as phenylsulfonyl; amino; hydroxy; alkoxy containing 1 to 4 carbon atoms, such as methoxy and ethoxy; and atoms completing with $R^1$ and $R^2$ a naphthalene nucleus;

$Z^1$ and $Z^3$ are each selected from the group consisting of hydrogen; bromine; chlorine; alkyl containing 1 to 4 carbon atoms, as described; aryl containing 6 to 10 carbon atoms, such as phenyl and tolyl; arylsulfonyl containing 6 to 12 carbon atoms, as described; amino, hydroxy; alkoxy containing 1 to 4 carbon atoms, such as methoxy and ethoxy; and $R^6SO_2NH$— wherein $R^6$ is alkyl containing 1 to 4 carbon atoms, such as methyl, ethyl, propyl and butyl; aryl containing 6 to 10 carbon atoms, such as phenyl and tolyl and hereto ring substituents, such as thienyl, quinolinyl and thiazyl,

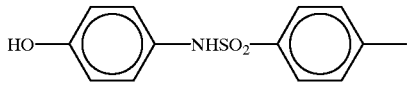

or

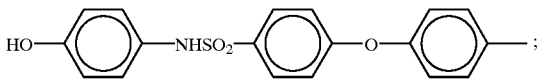

;

$Z^2$ is hydrogen, alkyl containing 1 to 4 carbon atoms, such as methyl, ethyl, propyl or butyl, chlorine and bromine when $R^1$ and $R^2$ are other than atoms completing a naphthalene nucleus; at least one of $Z^1$, $Z^2$ and $Z^3$ is $R^6SO_2NH$—.

The described groups such as alkyl, alkoxy and aryl include such groups containing substituents which doe not adversely affect the reducing properties and desired sensitometric properties of the described photothermographic elements and compositions. Examples of substituent groups which can be present are alkyl containing 1 to 3 carbon atoms such as methyl, ethyl, and propyl, chlorine, bromine and phenyl. In some cases it is desirable to avoid an amino group as a substituent. The amino group, in some cases, provides an overly active reducing agent.

One especially useful class of sulfonamidophenol reducing agents are compounds of the formula:

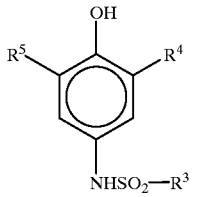

wherein $R^3$ is phenyl, naphthyl, methylphenyl, thienyl, quinolinyl, thiazyl, or alkyl containing 1 to 4 carbon atoms, as described;

$R^4$ is hydrogen, $R^3SO_2NH0$, alkoxy containing 1 to 4 carbon atoms, hydroxy, alkyl containing 1 to 4 carbon atoms, bromine or chlorine;

$R^5$ is hydrogen, bromine, chlorine, alkyl containing 1 to 4 carbon atoms, such as methyl, ethyl, propyl or butyl, or alkoxy containing 1 to 4 carbon atoms, such as methoxy, ethoxy and propxy. $R^3$, $R^4$ and/or $R^5$ can contain substituent groups which do not adversely affect the reducing properties of the described sulfonamidophenol reducing agents or the desired sensitometric properties of the photothermographic elements and materials of the invention. These substituent groups are the same as described for generic structure 1.

Another class of sulfonamidophenol reducing agents which are useful in photothermographic elements and compositions of the invention are sulfonamidonaphthols of the formula:

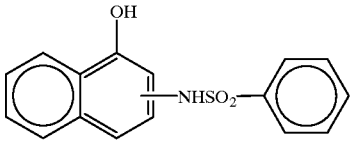

The sulfonamidophenol group in the described sulfonamidonaphthols can be in the ortho, meta or para position. The sulfonamidonaphthols are more active compounds within the sulfonamidophenol reducing agent class. Also, within this class, sulfonamidophenols which contain three sulfonamidophenol groups are more active. These sulfonamidophenols are employed for shorter developing times or with heavy metal salt oxidizing agents which are less active than silver behenate. In some cases, image discrimination provided by photothermographic materials containing the sulfonamidonaphthols and trifunctional sulfonamidophenols is less than that provided by other of the described sulfonamidophenols.

Combinations of sulfonamidophenol reducing agents, as described, can be employed in photothermographic and thermographic materials and elements according to the invention. Especially useful sulfonamidophenol reducing agents include benzenesulfonamidophenol reducing agents, such as 2,6-dichloro-4-benzenesulfonamidophenol and/or 4-benzenesulfonamidophenol.

Other organic reducing agents which can be employed alone or in combination with the described sulfonamidophenol reducing agents include substituted phenols and naphthols, for example, bis-β-naphthols include, such as described in U.S. Pat. No. 3,672,904 of deMauriac, issued Jun. 27, 1972. Suitable bis-β-naphthols include, for instance, 2,2'-dihydroxy-1,1'-binaphthyl; 6,6'-dibromo-2,2'-dihydroxy-1,1'-binaphthyl; 6,6'-dinitro-2,2'-dihydroxy-1,1'-binaphthyl and/or bis-(2-hydroxy-1-naphthol) methane.

Other reducing agents which can be employed in the described photothermographic materials according to the invention include polyhydroxybenzenes such as hydroquinone, alkyl-substituted hydroquinones such as tertiary butyl hydroquinone, methyl hydroquinone, 2,5-dimethyl hydroquinone and 2,6-dimethyl hydroquinone; catechols and pyrogallols; aminophenol reducing agents, such as 2,4-diminophenols and methylaminophenols; ascorbic acid developing agents such as ascorbic acid and ascorbic acid derivatives such as ascorbic acid ketals; hydroxylamine developing agents; 3-pyrazolidone developing agents such as 1-phenyl-3-pyrazolidone and the like. Combinations of these reducing agents can be employed if desired. The selection of an optimum reducing agent or reducing agent combination will depend upon particular photothermographic material, silver salt oxidizing agent, processing conditions, desired image and the like.

A so-called activator-toning agent, also known as an accelerator-toning agent or toner, can be employed in the photothermographic and thermographic materials according to the invention to obtain a desired image. The activator-toning agent can be a cyclic imide and is typically useful in a range of concentration such as a concentration of about 0.10 mole to about 1.1 mole of activator-toning agent per mole of silver salt oxidizing agent in the photothermographic material. Typical suitable activator-toning agents are described in Belgian Patent No. 766,590 issued Jun. 15, 1971. Typical activator-toning agents include, for example, phthalimide, N-hydroxyphthalimide, N-hydroxy-1,8-naphthalimide, N-potassium phthalimide, N-mercury phthalimide, succinimide and/or N-hydroxysuccinimide. Combinations of sol-called activator-toning agents can be employed if desired. Other activator-toning agents which can be employed include phthalazinone, 2-acetylphthalazinone and the like.

A photothermographic or thermographic element, as described according to the invention, can contain various non-gelatin compounds alone or in combination as vehicles, binding agents and in various layers. Suitable materials can be hydrophobic or hydrophilic. They are transparent or translucent and include such synthetic polymeric substances as water soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Effective polymers include water insoluble polymers of polyesters, polycarbonates, alkyl acrylates and methacrylates, acrylic acid, sulfoalkyl acrylates, methacrylates and those which have crosslinking sites which facilitate hardening or curing as well as those having recurring sulfobetaine units as described in Canadian Patent No. 774,054. Especially useful high molecular weight materials and resins include poly(vinyl butyral), cellulose acetate butyrate, polymethyl methacrylate, poly(vinyl pyrrolidone), ethylcellulose, polystyrene, polyvinyl chloride, chlorinated rubber, polyisobutylene, butadiene-styrene copolymers, vinyl chloride-vinyl acetate copolymers, copolymers, of vinyl acetate, vinyl chloride and maleic acid and polyvinyl alcohol.

The described iodide salt can be mixed with the described photothermographic compositions at different states of preparation of the composition.

Accordingly, one embodiment of the invention comprises a method of preparing a silver halide photothermographic composition or element comprising respectively A. preparing a dispersion of silver behenate in poly(vinyl butyral), B. mixing with the resulting silver behenate dispersion about 0.01 to about 0.50 mole of sodium iodide per mole of silver halide in the photothermographic composition, C. mixing with the resulting composition with an ex situ, poly(vinyl butyral) peptized photosensitive silver halide, and D. a poly(vinyl butyral) binder, and E. mixing succinimide, a sulfonamidophenol reducing agent and a spectral sensitizing dye with the resulting composition.

Another embodiment of the invention comprises a method of preparing a silver halide, photothermographic composition or element comprising respectively A. preparing poly(vinyl butyral) peptized photosensitive silver halide, B. mixing with said silver halide about 0.01 to about 0.50 mole of sodium iodide per mole of said silver halide, C. mixing with the resulting composition a dispersion of silver behenate in poly(vinyl butyral), and D. then mixing succinimide, a sulfonamidophenol reducing agent and a spectral sensitizing dye with the resulting composition.

In preparing a photothermographic material according to the invention, it is often desirable to mix the described iodide salt with the photothermographic material and then hold the resulting composition for a period of time until the desired sensitivity is achieved, such as about 10 seconds to about 48 hours at room temperature, that is about 20° C. to about 30° C. before any subsequent steps. It appears that this holding step provides some interaction which is desired for the described increase in photosensitivity. The exact mechanism of reaction which takes place is not fully understood.

After the holding period, the photothermographic composition can be coated on a suitable support to provide a photothermographic element.

Accordingly, a further embodiment of the invention comprises preparing a photothermographic composition comprising (A) preparing a dispersions of (a) an oxidation-reduction image-forming combination comprising (i) a silver salt oxidizing agent, typically silver behenate, and (ii) a sulfonamidophenol reducing agent, with (b) ex situ, synthetic polymer peptized photosensitive silver halide, in (c) a poly(vinyl butyral) binder, and, after preparing the dispersion, (B) mixing with the dispersion about 0.01 mole to about 0.50 mole, of the described iodide salt, typically sodium iodide, per mole of the silver halide, and then (C) holding the resulting composition for a period of time until the desired sensitivity is achieved, such as about 10 seconds to about 48 hours at about 20° C. to about 30° C. before any subsequent step.

After the holding step, a photothermographic element can be prepared by coating the described composition on a suitable support.

The photothermographic elements according to the invention can comprise a wide variety of supports. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like supports which can withstand the processing temperatures employed according to the invention. Typically, a flexible support is employed.

It is desirable, in some cases, to employ an image stabilizer and/or image stabilizer precursor in the described photothermographic or thermographic materials of the invention. Typical image stabilizers or stabilizer precursors are described, for example, in Belgian Patent No. 768,071 issued Jul. 30, 1971. Typical stabilizer precursors include, for example, azole thioethers and blocked azoline thione stabilizer precursors as described in this Belgian Patent and described in U.S. Pat. No. 3,700,457 of Youngquist, issued Oct. 24, 1972.

The described photothermographic and thermographic compositions and elements according to the invention can contain various addenda to aid the compositions and elements such as development modifiers that function as additional speed-increasing compounds, hardeners, antistatic layers, platicizers and lubricants, coating aids, brighteners, spectral sensitizing dyes, absorbing and filter dyes, also as described in the Product Licensing Index, Volume 92, December 1971, publication 9232, pages 107–110.

Spectral sensitizing dyes can be used in the described photothermographic and thermographic materials of the invention to confer additional sensitivity to the elements and compositions of the invention. Useful sensitizing dyes are described, for example, in the Product Licensing Index, Volume 92, December 1971, publication 9232, pages 107–110, paragraph XV and Belgian Patent No. 772,371 issued Oct. 15, 1971. For example, when a photothermographic material is to be exposed imagewise to a so-called red laser, a spectral sensitizing dye which provides a sensitivity to the red region of the spectrum is employed in the described photothermographic material according to the invention.

The photothermographic composition and other compositions according to the invention can be coated on a suitable support by various coating procedures including dip coating, air knife coating, curtain coating or extrusion coating using hoppers such as described in U.S. Pat. No. 2,681,294 issued Jun. 15, 1954. If desired, two or more layers can be coated simultaneously such as described in U.S. Pat. No. 2,761,791 issued Sep. 4, 1956 and British Patent No. 837,095.

A range of concentration of various components of the materials can be employed according to the invention. A useful concentration of reducing agent is typically about 0.25 mole to about 4 moles of reducing agent, such as sulfonamidophenol reducing agent, per mole of photosensitive silver halide in the photothermographic materials. In relation to the silver salt oxidizing agent employed, a useful concentration range of reducing agent is typically about 0.10 mole to about 20.0 moles of reducing agent per mole of silver salt oxidizing agent, such as silver behenate and/or silver stearate. If a combination of reducing agents is employed, the total concentration of reducing agent is typically within the described concentration range.

It is believed that upon imagewise exposure the latent image silver of the described photosensitive silver halide acts as a catalyst for the described oxidation image-forming combination. A typical concentration range of photosensitive silver halide is about 0.01 mole to about 20 moles of photosensitive silver halide per mole of silver salt oxidizing agent, for instance, per mole of silver behenate and/or silver stearate. Preferred photosensitive silver halides are silver chloride, silver bromide, silver bromoiodide, silver chlorobromoiodide of mixtures thereof. The photosensitive silver halide can be coarse or fine-grain, very fine-grain photosensitive silver halide being especially useful. The photosensitive silver halide can be chemically sensitized, can be protected against the production of fog and/or stabilized against the loss of sensitivity during keeping, as described in the Product Licensing Index reference mentioned previously.

The described ex situ, synthetic polymer peptized photosensitive silver halide can be prepared with a range of synthetic polymer peptizers. Useful synthetic polymer peptizers include, for example, those described in U.S. Pat. No. 3,713,833 of Lindholm et al, issued Jan. 30, 1973 and U.S. Pat. No. 3,706,565 of Ericson, issued Dec. 19, 1972, and vinyl pyridine polymers, e.g., polymers of 2-vinyl pyridine, 4-vinylpyridine and 2-methyl-5-vinylpyridine.

Poly(vinyl acetals), such as poly(vinyl butyral), are especially useful as peptizers in the described preparation of ex situ silver halide. The procedure can be carried out in a non-aqueous medium under controlled reaction conditions. For instance, an organic solvent, such as acetone or methylisobutyl ketone, can be employed with the peptizer, such as poly(vinyl butyral). An example of a suitable preparation of photosensitive silver halide is as follows: Lithium bromide, silver trifluoroacetate and poly(vinyl butyral) are mixed in acetone under controlled conditions. The resulting, fine-grain silver bromide can then be mixed with an oxidation-reduction image-forming combination, such as a sulfonamidophenol with silver behenate, to provide a photothermographic material.

The silver halide employed in the practice of the invention can be unwashed or washed to remove soluble salts. In the latter case, the soluble salts can be removed by chill-setting and decantation or an emulsion containing the silver halide can be coagulation washed.

Poly(vinyl acetal) peptized photosensitive silver halide is useful and is described, for example, in Belgian Patent No. 774,436 issued Nov. 12, 1971. The photosensitive silver halide is prepared according to this method by mixing a source of silver ions with a source of halide ions in the presence of a poly(vinyl acetal) such as poly(vinyl butyral). This polymer peptized photosensitive silver halide is especially useful when the photothermographic material contains a polymeric binder which is the same as the polymer employed to peptize the silver halide. For example, the polymeric binder can be poly(vinyl butyral) which can be employed to peptize the photosensitive silver halide.

An especially useful embodiment of the invention is in a photothermographic composition comprising the combination of (a) an oxidation-reduction image-forming combination comprising (i) silver behenate and/or silver stearate with (ii) a sulfonamidophenol reducing agent, as described, with (b) poly(vinyl butyral) peptized silver halide in (c) a poly (vinyl butyral) binder, the improvement comprising (d) about 0.01 mole to about 0.50 mole, such as about 0.01 mole to about 0.15 mole, of sodium iodide per mole of the silver halide. With this composition an especially useful activator-toning agent is succinimide.

After imagewise exposure of the described photothermographic element according to the invention, typically to visible light, the resulting latent image can be developed merely by uniformly overall heating the element to moderately elevated temperatures. This merely involves overall heating the described photothermographic element from about 80° C. to about 250° C. such as for about 0.5 seconds to about 60 seconds. In thermographic elements, the desired heating is at about 60° C. to about 225° C. for about 0.001 to 60 seconds. By increasing or decreasing the length of time of heating, a higher or lower temperature within the desired range can be employed depending upon the desired image, particular photothermographic material and the like. A developed image is typically produced within several seconds, such as about 0.5 second to about 60 seconds. A processing temperature of about 100° C. to about 165° C. is especially useful.

While visible light can be employed to produce the latent image, other sources of electromagnetic radiation can be employed. For example, the described photothermographic elements of the invention are useful for high intensity imagewise exposure. A laser can be employed to produce an image in the described photothermographic material.

Any suitable means can be used for providing the desired processing temperature range. The heating means can be a simple hot plate, iron, roller or the like.

Processing is usually carried out under ambient conditions of pressure and humidity. Conditions outside normal atmospheric pressure and humidity can be employed if desired.

If desired, one or more components of the photothermographic element described can be in one or more layers of the element. For example, in certain cases it can be desirable to include certain percentages of the reducing agent, activator toner, image stabilizer and/or stabilizer precursor in a protective layer over the photothermographic element. This in some cases can reduce migration of certain addenda in the layers of the photothermographic element.

It is noted that in the above preparations the iodide must contain less than 100 micrograms of ionic formate per gram of iodide salt. Thus, the iodide salt must be tested first for ionic formate concentration and then the ionic formate concentration, if high, can be reduced by conventional purification procedures such as distillation and recrystallization.

It is noted that the iodide salt of the composition is one which has been formed using an ionic formate as a starting material. Thus, major problems have been demonstrated wherein the iodide salt is formed using ionic formates such as sodium formate, lithium formate and formic acid, while non-ionic formates such as ethyl formate does not form appreciable fog when used to form the iodide.

The ionic formate concentration can be determined by high pressure liquid chromatography (HPLC) as depicted below.

In the case of photothermographic or thermographic films wherein the ionic formate is from other sources in the film, the film must not contain more than 0.5 micrograms of ionic formate per gram of emulsion in the film.

If the formate concentration is greater than 0.5 micrograms of ionic formate per gram of emulsion in the film, than the film is purified as to ionic formate by conventional methods.

The following example is included for a further understanding of the invention.

EXAMPLE 1

A. Analytical Methods

Reagents. All water used in this work was 18 Megohm quality obtained from a Milli-Qplus purification system with Kodak HP water as feed. Ion exchange eluents were prepared from 50 Wt % sodium hydroxide (Fisher Scientific, Fair Lawn, N.J.) and HPLC grade methanol (J. T. Baker, Phillipsburg, N.J.). Sulfuric acid used to prepare the regenerant in the ion exchange work and to prepare the eluent in ion exclusion was ULTREX from J. T. Baker. A sodium formate (Aldrich Chemical Co., Milwaukee, Wis.), potassium iodate and sulfamic acid (Eastman Kodak Co., Rochester, N.Y.), standard was prepared by weighing the appropriate mass of each compound into a 100 mL volumetric flask to make 1000 $\mu$g/mL concentrations. This was diluted accordingly to make working standard concentrations.

IC Separation Method 1. The instrument was a Dionex DX300 (Dionex Corp., Sunnyvale, Calif.) system with the AGPM small bore pump and CDM-II conductivity detector. This was an ion exchange separation on a 2 mm Dionex IonPac AS10 column with 100 mM sodium hydroxide in 10 volume% methanol at a flow rate of 0.25 mL/min. Chemically suppressed conductivity detection was afforded by the use of 25 mM sulfuric acid to regenerate the Dionex membrane suppresser (AMMS 2 mm). Data was acquired with PE/Nelson Turbochrome software version 3.2 (PE Nelson, Norwalk, Conn.).

IC Separation Method 2. The instrument was a Dionex 4500 system with a GPM pump and a Kratos 783 variable wavelength detector. This was an ion exclusion procedure on a Sarasep (Sarasep, Santa Calara, Calif.) WA1 column with 3.0 mN sulfuric acid at a flow rate of 0.60 mL/min and UV detection at 210 nm. Data was acquired on a Dionex AI450 system.

Sample Preparation. For the ion exchange work, 0.02 g of sample was weighed to the nearest 0.00001 g, into a 10 mL volumetric flask. For the ion exclusion work and ion exchange work on samples that contained low levels of formate, i.e. less than 100 microgram per gram sampled was weighed to the nearest 0.0001 g into a 10 mL volumetric flask. The sample was dissolved in water, and then diluted to volume with water, and mixed. For the ion exchange work a Dionex OnGuard Ag cartridge was flushed by driving 60 mL of water through a syringe. Following the aqueous flushing, 7–8 mL of sample was forced through the cartridge and discarded. A portion of the final 2–3 mL was collected in an autosampler vial. The $Ag^+$ loaded cation exchange cartridge removed iodide by precipitating AgI in the cartridge. The resulting aqueous solution was free of iodide (technically, the iodide is reduced to a concentration determined by the solubility product constant of AgI under conditions present in the cartridge) enabling shorter chromatographic analysis time. For ion exchange work, the Ag cartridge preparation is not necessary.

IR Conditions. IR spectra were obtained on a Nicolet 550 spectrometer. The sample was prepared by grinding in a Wig-L-Bug apparatus for about 20 seconds. The neat sample was then pressed into a pellet, placed in a spectrometer, and the spectrum obtained between 4000 and 500 $cm^{-1}$.

NMR Conditions. Proton NMR spectra were obtained on a Varian 300 Mhz spectrometer. About 50 mg of sample was dissolved in deuterium oxide. A standard proton NMR spectrum was obtained.

B. Preparation of Sodium Formate Spiked Dispersions for Coating Evaluation

The goal of this experiment was to determine whether the intentional addition of sodium formate to a dispersion of silver behenate, sodium iodide, MIBK, and Butvar would cause black spot formation. Sodium formate was added at 0.0, 0.01, 0.1, and 1.0 weight % in sodium iodide to the AgBe dispersion.

To 86.2 g of AgBe dispersion above which was certified "free" of spots) was added four aliquots of a 1.0% sodium formate solution.

a. 0.00 g (check)
b. 0.021 g
c. 0.21 g
d. 2.13 g

The spiked dispersions of AgBe dispersion above were stirred for three hours. To each spiked AgBe dispersion above was added a standard emulsion layer formulation which consisted of the following addenda.

a. 16.7 g of ex-situ AgBr grains dispersed in MIBK
b. 10.2 g of a 10% solution of succinimide in Butvar/acetone c. 9.2 g of a 2.5% solution of antifoggant in Butvar/acetone d. 2.2 g of a 2.5% solution of photobleach in Butvar/acetone e. 3.5 g of a 10% solution of palmitic acid in Butvar/acetone f. 26.7 g of makeup Butvar/MIBK These four melts were mixed for 16 hours then to each was added the following solutions.

a. 9.6 g of a 0.20% solution of cyanine sensitizing dye in methanol b. 37.3 g of a 10% solution of sulfonamidophenol developer in Butvar/MIBK Each final emulsion layer was coated 5.31 g/ft$^2$ wet laydown using a standard drying profile. Finally, each emulsion layer was overcoated with a common sol-gel layer. The films were processed at 125° C.

Sodium iodide samples for molecular sulfur determination by LC-EC were initially prepared at 20 mg/mL in water and extracted with methylene chloride, which allows quantification of sulfur at 1 ppm relative to the sample. No sulfur was observed in any of the samples. Because of the high solubility of NaI in water, samples were again prepared at 1 g/mL water and extracted with methylene chloride. This allowed quantification at about 20 ppb relative to the sample. Samples were all less than 20 ppb sulfur. At 1 g/mL there was a difference in physical appearance after time, however. Samples had turned yellow with varying degrees of intensity, from very intense (Sample 6) to colorless (Sample 7). Samples were rank ordered by color intensity and compared to fitness for use data in Table 1.

The color change was thought most likely due to the oxidation of iodide to iodine, which is accelerated in the presence of air under acidic conditions. The pH of three samples prepared at 0.5 g/mL in water were tested (Table 1). Sample 6, the first lot exhibiting problems had the lowest pH. Sample 7, which gave no spots had the highest pH. Sample 1 which was the poorest regarding black spot formation had an intermediate pH.

Five lots of sodium iodide were chromatographed by ion chromatography based on method 1 conditions described above. An early eluting peak was observed at an appreciable level (ca 0.1 Wt %) in the bad samples (i.e., 1, 3, and 6) but not in the good lots (5 and 7) (3). This unknown peak did not exhibit a retention match with iodate or acetate. Acetate is frequently seen in a variety of samples inorganic as well as organic. Iodate was thought to be a likely impurity in sodium iodide dependent upon the means of manufacture. Fluoride, formate, and sulfamate elute in the vicinity of the unknown peak and were all chromatographed individually. Of the three, formate gave an exact retention time and peak shape match. Fluoride eluted too early while sulfamate was too late.

TABLE 1

Black Spot Problem with NaI

| Lot Number | Black Spots | Formate Level | No. | pH | Color Rank |
|---|---|---|---|---|---|
| 32178331 | No spots | 21 | | | |
| 32189341 | No spots | 12 | 5 | | 3 |
| 34055413 | Poor | 470 | 6 | 6.3–6.4 | 1 |
| 34076421 | Poor | 440 | 3 | | 2 |
| 34115429 | Poorest | 900 | 1 | 6.9–7.0 | 4 |
| 34141438 | Poor | 580 | | | |
| 113932315 | No spots | 16 | 7 | 8.9–9.0 | 5 |

TABLE 1-continued

Black Spot Problem with NaI

| Lot Number | Black Spots | Formate Level | No. | pH | Color Rank |
|---|---|---|---|---|---|
| 113931122 | Poor | 610 | | | |
| 113942664 | No spots | 9.4 | | | |
| 34270 | No spots | 9.6 | | | |

Formate concentrations are reported in micrograms/g NaI

Because of the eventual elution of iodide more than one hour after sample injection, it was necessary to remove it prior to separation method 1. Silver loaded cation exchange cartridges commercially available from a few sources are routinely used for this purpose. Dionex OnGuard $Ag^+$ cartridge blanks showed no evidence of the unknown peak after flushing with 60 mL of water. Samples were also injected without passing them through the cartridge and showed the same area response for the unknown as with cartridge treatment. This verifies that the cartridge does not contribute the unknown peak nor does it remove it from the samples. Finally, an injection was made immediately after dissolving a sample containing the unknown peak. The area response for the unknown was the same whether it was passed through the cartridge or injected immediately after making it up without passage through the cartridge. This argues against an oxidation or degradation process producing the unknown peak in the sample on the preparation time scale of the analysis.

Separation method 1 was an anion exchange separation on a Dionex AS10 column. The unknown peak elutes early (3.8 minutes) under the conditions specified in the experimental section. Early eluting species in anion exchange are typically the most weakly retained within a series. Retention among the halides follows the order $F<Cl^-<Br^-<I^-$ while among the halate ions the order is $IO_3^-<BrO_3^-<ClO_3^-$. Sulfonates with a very small R-group and the smallest monocarboxylic acids will also have weak retention by ion exchange. Several other weak inorganic acids elute early but are not detected well by conductivity and of no consequence in this problem. The data tabulated in Appendix 1 clearly show an exact retention time match with the unknown peak observed in certain poor lots of sodium iodide and formate (see also Table 1). This assignment is based on a retention time and peak shape match for a single chromatographic method. To verify the presence of formate, a characterization technique or second analytical technique was required.

Ideally, IC-MS would provide molecular weight information. The VG 20-250 quadruple mass spectrometer equipped with an ion spray with a heated capillary has not been successfully applied to carboxylic acids to date. In addition, the low mass of formate will be problematic given the background noise inherent at m/e<100(4). However, NMR and IR data confirmed formate in certain samples and also showed some evidence of lesser amounts of acetate which were not observed in this work. An NMR spectrum of sample 34055413 showed formate and acetate at chemical shifts of 8.5 and 1.9 ppm, respectively. Reference to Table 1 shows this was a poor lot with 470 $\mu$g/g formate measured by ion chromatography method 1. The NMR spectrum was shown in Appendix 2. The IR data shows O—H bending vibrations for formate and acetate at 1370 and 1430 cm$^{-1}$, respectively. The sample prep with the $Ag^+$ loaded cation exchange cartridge contributes a low level of acetate (or acetate interfering) peak. Thus, acetate could not be readily confirmed chromatographically.

As a final confirmation of formate, a second chromatographic method was proposed. The mode of separation and means of detection both differ from the first method. If again, a match with formate is observed then this is powerful evidence for the identity of the unknown component in the sodium iodide. In a chromatographic sense, equivalent retention time and peak shape between standard and sample would constitute a match.

Separation method 2 used a Sarasep WA column and is based on ion exclusion chromatography. This separation with the conditions specified in the Experimental Section presumes the unknown is a weak acid. An acid eluent is used to protonate the acid and a cation exchanger serves as the stationary phase. Strong acids will not be protonated and will be repelled from entering into the cation exchange resin by so called Donnan exclusion. Weak acids are protonated to varying degrees dependent upon their $pK_a$ and will partition into the stationary phase (partition type interactions are thought to play a role in this retention mechanism (5)).

The retention time and peak shape match for formate were confirmed in both methods (3). In addition, the table below shows equivalent concentrations were obtained with the two methods.

TABLE 2

Formate in NaI - Comparison of IC Methods

| Method | Units | Sample 1 | Sample 3 | Sample 5 | Sample 6 | Sample 7 |
|---|---|---|---|---|---|---|
| 1 | μg/g | 900 | 440 | 16 | 480 | 16 |
| 2 | μg/g | 920 | 500 | ND | 470 | ND |

Sample numbers were taken from Table 1.

A level series of sodium formate concentrations was spiked into a silver behenate dispersion and coated on a suitable support and dried. The concentration series was correlated with the level of black spots and fog. A melt batch that had been certified "free" of black spot causing agents was used as a check. The data are summarized in Table 3 below. The results show increasing sodium formate concentration causes a dramatic increase in black spots and fog as well. The level of black spots is based upon the relative spot density per unit area observed through a loupe. At 0.21 mg sodium formate/200 g of melt, the spots are described as bad. This formate concentration in the melt corresponds to 0.01 Wt % sodium formate in sodium iodide.

TABLE 3

Black Spots As A Function Of Sodium Iodide Concentration

| Coating ID | Concentration NaCOOH | Level Black Spots | Fog, Dmin |
|---|---|---|---|
| −1 | 0.00 mg/200 g melt | Near zero | 0.10 |
| −2 | 0.21 mg/200 g melt | BAD | 0.20 |
| −3 | 2.13 mg/200 g melt | TERRIBLE | 0.60 |
| −4 | 21.3 mg/200 g melt | {Dmax fog in Dmin areas} | |

The data in Table 3 confirm the relationship between formate concentration and black spots on these microfilms.

Thus, certain lots of sodium iodide have been correlated with black spot problems in dry laser microfilm. The chromatographic data clearly show the presence of an unknown impurity in bad lots of sodium iodide. This peak has been confirmed as formate. The earlier mentioned JP 1/26,224 describes how this compound finds itself in certain lots of sodium iodide. Coating experiments with spot-free melts spiked with varying concentrations of sodium formate shows a high correlation between black spot formation and increasing concentration of formate.

EXAMPLE 2

A series of experiments were run using iodide salts prepared from various formates, both ionic and non-ionic as follows:

Table 4 shows a list of formate containing compounds that were spiked into a photothermographic formulation on an equimolar basis, similar to the procedure outlined in Table 3.

TABLE 4

Effect of Various Formates on Black Specks and Fog

| Coating ID | Formate Compound | Formate Conc. mg/ft$^2$ | Relative Black Speck Level | Dmin |
|---|---|---|---|---|
| B1 | None, Check | 0 | None | 0.14 |
| B2 | Ethyl Formate | 0.69 | None | 0.14 |
| B3 | Formic Acid | 0.43 | Total Fog | 3.63 |
| B4 | Lithium Formate | 0.49 | Heavy | 0.28 |
| B5 | Sodium Formate | 0.63 | Heavy | 0.26 |

The above shows that only the iodide salts formed from ionic formates such as formic acid, lithium formate and sodium formate cause heavy pepper fog, while the non-ionic formates such as ethyl formate do not create a substantial pepper fog problem with silver behemate containing photographic compositions.

While the invention has been described with particular reference to a preferred embodiment, it will be understood by those skilled in the art that various changes can be made and equivalents may be substituted for elements of the preferred embodiment without departing from the scope of the invention. In addition, many modifications may be made to adapt a particular situation or material to a teaching of the invention without departing from the essential teachings of the present invention.

We claim:

1. A method of preparing a photothermographic composition comprising:

A. preparing a dispersion of:
  a. an oxidation-reduction image-forming combination comprising:
    i. a silver salt oxidizing agent and
    ii. an organic reducing agent with:
  b. a synthetic polymer-peptized photosensitive silver halide, and
  c. a toner in
  d. a non-gelatin polymeric binder and B. mixing with said dispersion a sensitizing concentration of iodide salt formed from an ionic formate and C. the improvement wherein said iodide salt contains less than about 100 micrograms of ionic formate per gram of iodide salt.

2. The method of claim 1 wherein the ionic formate is selected from the group consisting of sodium formate, lithium formate and formic acid.

3. The method of claim 1 wherein the iodide salt is sodium iodide.

4. The method of claim 1 wherein the iodide salt contains less than about 100 micrograms of ionic formate per gram of iodide salt.

5. The method of claim 1 wherein said iodide salt is purified so as to contain less than 100 micrograms of ionic formate per gram of iodide salt.

6. The method of claim 1 wherein the iodide salt concentration is about 0.01 mole to about 0.50 moles per mole of photosensitive silver halide.

7. The method of claim 1 wherein the toner is a cyclic imide.

8. A method of preparing a thermographic composition comprising:

A. preparing a dispersion of:
   a. an oxidation-reduction image-forming calibration comprising:
      i. a silver salt oxidizing agent and
      ii. an organic reducing agent with:
   b. a toner;
   c. a non-gelatin polymeric binder and B. mixing with said dispersion and sensitizing concentration of iodide salt formed from an ionic formate and C. the improvement wherein said iodide salt contains less than about 100 micrograms of ionic formate per gram of iodide salt.

9. The method of claim 8 wherein the ionic formate is selected from the group consisting of sodium formate, lithium formate and formic acid.

10. The method of claim 8 wherein the iodide salt is sodium iodide.

11. The method of claim 8 wherein the iodide salt contains less than about 100 micrograms of ionic formate per gram of iodide salt.

12. The method of claim 8 wherein said iodide salt is purified to contain less than 100 micrograms of ionic formate per gram of iodide salt.

13. The method of claim 8 wherein the iodide salt concentration is about 0.01 mole to about 0.50 moles per mole of photosensitive silver halide.

14. The method of claim 8 wherein the toner is a cyclic imide.

15. A method of preparing a photothermographic film comprising:

A. preparing a dispersion of:
   a. an oxidation-reduction image-forming combination comprising:
      i. a silver salt oxidizing agent and
      ii. an organic reducing agent with:
   b. a synthetic polymer-peptized photosensitive silver halide, and
   c. a toner in
   d. a non-gelatin polymeric binder and B. mixing with said dispersion a sensitizing concentration of iodide salt formed from an ionic formate and C. forming a film therefrom and D. the improvement wherein said film contains less than about 0.5 micrograms of ionic formate per gram of emulsion in the film.

16. The method of claim 15 wherein the ionic formate is selected from the group consisting of sodium formate, lithium formate and formic acid.

17. The method of claim 15 wherein the iodide salt is sodium iodide.

18. The method of claim 15 wherein the iodide salt contains less than about 100 micrograms of ionic formate per gram of iodide salt.

19. The method of claim 15 wherein said iodide salt is purified so as to contain less than 100 micrograms per gram of ionic formate in the iodide salt.

20. The method of claim 15 wherein the iodide salt concentration is about 0.01 mole to about 0.50 moles per mole of photosensitive silver halide.

21. The method of claim 15 wherein the toner is a cyclic imide.

22. A method of preparing a thermographic film comprising:

A. preparing a dispersion of:
   a. an oxidation-reduction image-forming combination comprising:
      i. a silver salt oxidizing agent with
      ii. an organic reducing agent
   b. a toner in a polymeric binder
   c. a non-gelatin polymeric binder and B. mixing with said dispersion a sensitizing concentration of iodide salt formed from an ionic formate and C. forming a film therefrom and D. the improvement wherein said film contains less than about 0.5 micrograms of ionic formate per gram of emulsion in the film.

23. The method of claim 22 wherein the ionic formate is selected from the group consisting of sodium formate, lithium formate and formic acid.

24. The method of claim 22 wherein the iodide salt is sodium iodide.

25. The method of claim 22 wherein the iodide salt contains less than about 100 micrograms of ionic formate per gram of iodide salt.

26. The method of claim 22 wherein said iodide salt is purified so as to contain less than 100 micrograms of ionic formate per gram of iodide salt.

27. The method of claim 22 wherein the iodide salt concentration is about 0.01 mole to about 0.50 moles per mole of photosensitive silver halide.

28. The method of claim 22 wherein the toner is a cyclic imide.

* * * * *